United States Patent [19]

Sanders

[11] Patent Number: 4,633,508

[45] Date of Patent: Dec. 30, 1986

[54] DEVICE FOR UNITING COMPONENTS ONE TO ANOTHER

[75] Inventor: Bernard Sanders, St. Peter, Channel Islands

[73] Assignee: Beiersdorf A.G., Hamburg, Fed. Rep. of Germany

[21] Appl. No.: 643,282

[22] Filed: Aug. 22, 1984

[30] Foreign Application Priority Data

Aug. 25, 1983 [GB] United Kingdom ..... 8322884

[51] Int. Cl.[4] ..... B65D 33/16

[52] U.S. Cl. ..... 383/95; 229/48 SB; 383/62

[58] Field of Search ..... 383/62, 93, 95; 206/632; 229/48 SA, 48 SB

[56] References Cited

U.S. PATENT DOCUMENTS

| | | | |
|---|---|---|---|
| 2,991,001 | 7/1961 | Hughes | 383/93 |
| 3,079,066 | 2/1963 | Roop | 206/632 |
| 3,085,738 | 4/1963 | Bok | 206/632 |
| 3,128,936 | 4/1964 | Sprosty | 206/632 |
| 3,279,331 | 10/1966 | Platt | 383/95 |
| 3,339,606 | 9/1967 | Kugler | 383/93 |

FOREIGN PATENT DOCUMENTS

| | | | |
|---|---|---|---|
| 952487 | 8/1974 | Canada | 383/95 |

*Primary Examiner*—Stephen P. Garbe

*Attorney, Agent, or Firm*—Neuman, Williams, Anderson & Olson

[57] ABSTRACT

A device for uniting components, for example opposite facing panels of a bag adjacent an opening of the bag, one to another having an opening in one of the components, a pressure sensitive contact adhesive member in adhesive contact with the component so as to bridge the opening and spacer member for spacing the components one from another. The components are united one with another by deforming the adhesive member or the opposite facing component into the opening so that the adhesive contacts an opposite facing surface of the opposite facing component.

5 Claims, 17 Drawing Figures

DEVICE FOR UNITING COMPONENTS ONE TO ANOTHER

BACKGROUND OF THE INVENTION

1. Field of the Invention

This invention relates to a device for uniting components one to another and may comprise a closure for a bag.

2. Description of the Prior Art

It is known to provide open bags made of synthetic plastics film material in which contents are inserted and the bags subsequently closed.

Various forms of closure have been used and proposed for such bags, and a common form of closure comprises a portion of pressure sensitive contact adhesive provided on a surface of the material of which a bag is formed, the adhesive being located at an opening of the bag.

A disadvantage of bags having closure means in the form of pressure sensitive contact adhesive is that it is necessary to mask the adhesive during transit and storage of the bags prior to use, the bags generally being stacked, since otherwise the bags will adhere one to another. Masking of adhesive generally is effected by covering the adhesive with a tape having a release coating in contact with the adhesive so that, when it is necessary to effect closure of a bag, the masking tape can be peeled from the adhesive, which remains on the material of the bag, to expose the adhesive.

Apart from the cost of providing masking tape, bags having masking tape covering adhesive closure means have a disadvantage in that it is necessary to remove the masking tape before closure of a bag can be effected. It is desirable, therefore, to provide a device for uniting components one to another which device may comprise a closure for a bag in which pressure sensitive contact adhesive is not covered by masking tape and thereby is less expensive to produce and less time consuming to effect closure thereof compared with closures for bags known hitherto.

One such device is known which comprises a first component, such as a panel of a bag, a second component, such as a second panel of the bag facing the first panel, the second component having an elongate opening therein and a membrane having pressure sensitive contact adhesive thereon, the membrane being united with a first surface of the second component such that the adhesive bridges the opening and contacts the surface of the first component through the opening when that surface is adjacent the second surface of the second component remote from the membrane. An example of such a device is described in French Patent No. 2,345,355 (Janowski) with reference to FIG. 1 of the drawings accompanying the specification of that patent.

A disadvantage of such device is that whenever the said surface of the first component, or indeed any other surface of another component for example, is located adjacent the second surface of the second component, the said surface of the first component is contacted by the adhesive. If the first and second components are panels of a bag, such contact can result in premature and unwanted closing of the bag or, if the other surface comprises a surface of an article being inserted into or removed from the bag, in contamination of the article by the adhesive and/or contamination of the adhesive by the article.

SUMMARY OF THE INVENTION

It is an object of the present invention to avoid premature contact of the surface of one component or any other surface of an article by the adhesive of a membrane having adhesive on it and bridging and closing an opening in another component.

In the present invention the aforementioned problem is solved through a device for uniting components one to another having a first component with an opening and a membrane with pressure sensitive contact adhesive thereon. The membrane is united with a first surface of the first said component such that it bridges the opening. The opening is of such dimension that when the components are located such that a surface of the first component is adjacent a surface of the second component remote from the membrane, the adhesive is spaced from contact with the said surface of the first component but is contactable therewith by deforming a portion of the first component or a portion of the membrane into the opening.

In this manner, premature contacting of the said surface of the first component, or any other surface of another article, by the adhesive is avoided since such contact is only effected by the positive act of deforming a portion of the first component or a portion of the membrane into the opening.

BRIEF DESCRIPTION OF THE DRAWINGS

For a more complete understanding of this invention reference should now be made to the embodiments illustrated in greater detail in the accompanying drawings and described below by way of examples of the invention. In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWINGS INCLUDING PREFERRED EMBODIMENTS

Figure 1:
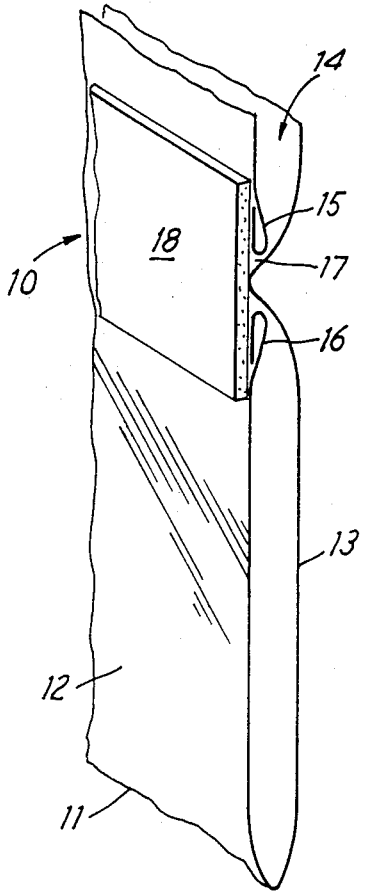
FIG. 1 is a diagrammatic representation, shown partly in cross section, of a bag provided with one embodiment of a device in accordance with the present invention.

Referring now to FIG. 1 of the drawings, there is shown a diagrammatic representation of a bag 10 formed of a sheet of synthetic plastics film material having a bottom fold 11, a front panel 12 and a rear panel 13. Upper portions of the front and rear panels 12 and 13 remote from the fold 11 define an opening 14 of the bag 10. The front panel 12 is slit in a direction extending substantially parallel to the fold 11, opposite marginal portions of the material of the front panel 12 defining the slit being folded outwardly of the front panel 12 and away from one another to form outwardly turned folds 15, 16 defining a slot 17 extending substantially parallel to the bottom fold 11 of the bag 10. The slot 17 and the folds 15, 16 are bridged by an adhesive tape 18, the tape extending longitudinally of the slot 17 and transversely beyond the folds 15, 16 whereby the adhesive of the tape 18 adheres to the folds 15, 16 and adjacent portions of the front panel 12 and is exposed to an inner surface of the rear panel 13 through the slot 17. The front and rear panels 12, 13, the tape 18 and the folds 15, 16 are sealed one to another in spaced substantially parallel side seams (not shown) extending substantially at right angles to the bottom fold 11 of the bag.

The arrangement is such that the dimensions of the slot 17 are such that an inner surface of an upper portion of the rear panel 13 can be located adjacent to, or even in contact with, an inner surface of the front panel 12 without the adhesive of the tape 18 exposed through the slot 17 contacting an opposite facing portion of the inner surface of the rear panel 13. Contact of the adhesive of the tape 18 through the slot 17 with a portion of an inner surface of the rear panel 13 is effected only by deforming the surface of the rear panel 13 in a longitudinal direction of the slot 17 so that a longitudinally extending portion of the rear panel 13 in a direction of the slot 17 enters the slot 17 and adheres to the adhesive of the tape 18 thereby to effect closure of the bag 10.

Alternatively, the material of the tape 18 may be deformed longitudinally of the slot 17 so as to extend through the slot and contact an opposite facing portion of the inner surface of the rear panel 13.

It is preferred, however, that the adhesive tape 18 be of "stiff" material and that closure of the bag 10 is effected by deforming an upper portion of the rear panel 13 longitudinally of the slot 17.

It will be appreciated that the adhesive of the tape 18 may be a "permanent" adhesive whereby, once the bag 10 is closed, it cannot subsequently be opened without destroying the material of the bag. Alternatively, the adhesive of the tape 18 may be "re-usable" such that the bag may be opened and re-closed and repeatedly re-opened and re-closed.

It would also be appreciated that the folds 15, assist in maintaining separation of the exposed adhesive of the tape 18 through the slot 17 and an opposite facing adjacent portion of the inner surface of the rear panel 13.

Figure 2:
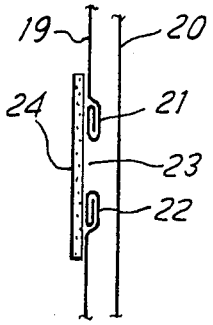
FIG. 2 is a diagrammatic cross section of portions of opposite facing panels of a bag provided with a modification of the embodiment of the device shown in FIG. 1, the device being in an open condition.
Figure 3:
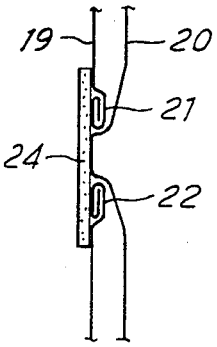
FIG. 3 is a view similar to FIG. 2 showing the device in a closed position.

Referring now to FIGS. 2 and 3 of the drawings, there is shown front and rear panels 19, 20 of a bag similar to the front and rear panels 12, 13 of the bag 10, wherein the front panel 19 is slit and opposite marginal portions defining the slit are curled away from one other to provide multi-layer folds 21, 22 defining a slot 23. The slot 23 is bridged by adhesive tape 24.

The arrangement is such that the multi-layered folds 21, 22 provide an increased dimension in a direction between the adhesive tape 24 and the rear panel 20 whereby the dimension of the slot 23 in a direction between the multi-layered folds 21, 22 can be increased proportionally without premature attachment of the tape 24 and the rear panel 20 one to another.

Figure 4:
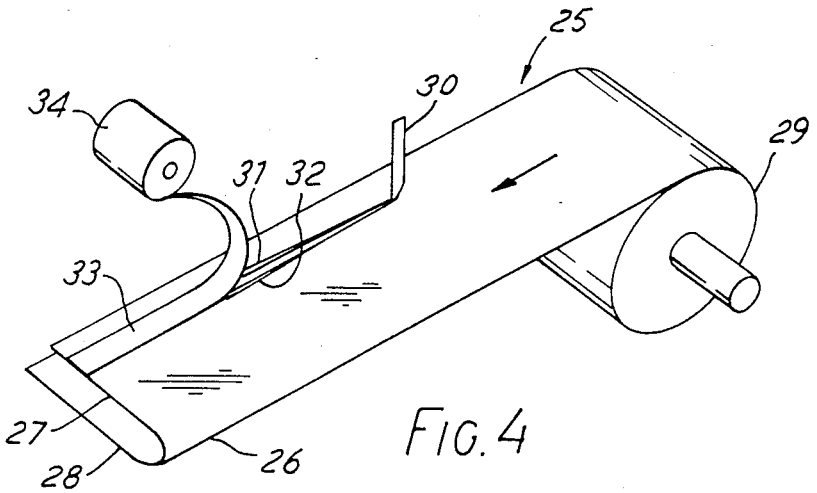
FIG. 4 is a diagrammatic representation showing a method of manufacturing bags provided with a device in accordance with the present invention.

Referring now to FIG. 4 of the drawings, there is shown, diagrammatically, a method of forming bags shown in FIGS. 1 to 3. In the method, a web 25 has been folded longitudinally at 26 to form an upper layer 27 superimposed on a lower layer 28, the layers being of equal dimension, and the web 25 is being wound to form a reel 29. The folded web 25 is unwound from the reel 29 and is advanced towards a blade 30 which slits that upper layer 27 longitudinally adjacent a marginal edge thereof remote from the longitudinal fold 26. The longitudinal marginal portions defining the slit are folded outwardly in opposite directions transversely of the direction of movement of the web 25 by means of a tool (not shown) to form outwardly oppositely folded longitudinally extending folds 31, 32. The folds 31, 32 have applied thereto an adhesive tape 33 unwound from a reel 34 located above the web 25, the adhesive of the tape 33 contacting the folds 31, 32 and maintaining the folds in the folded condition to define a longitudinally extending slot therebetween.

The folded and slit web 25 having the adhesive tape applied thereto subsequently is advanced to a severing station (not shown) whereby the web and the tape 33 adhered thereto are severed transversely of the direction of movement of the web 25 such that the web and tape 33 are cut and provided with spaced substantially parallel transversely extending seams to form completed bags.

Figure 5:
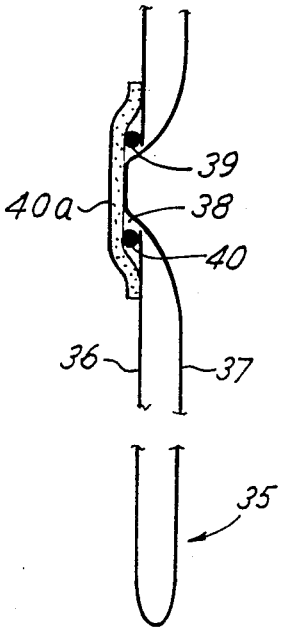
FIG. 5 is a diagrammatic representation of another embodiment of a device in accordance with the present invention.

Referring now to FIG. 5 of the drawings, there is shown in diagrammatic cross section, another embodiment of a bag 35 having front and rear panels 36, 37. Unlike in the embodiments shown in FIGS. 1 and 2 and 3, however, the front panel 36 of the bag 35 is not slit and the marginal portions thereof folded to provide a slot. Instead, the front panel 36 of the bag 35 is provided with a slot 38 and a pair of filaments 39, 40 are located adjacent opposite marginal edge portions of the slot 38 and are secured to an outer surface of the front panel 36 by means of an adhesive tape **40*a* which bridges the slot 38 and adheres to the filaments 39, 40 and to the outer surface of the front panel 36**.

Figure 6:
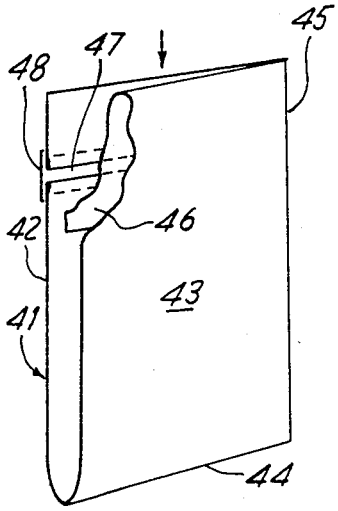
FIGS. 6 to 11 inclusive are diagrammatic representations of different bags each provided with one or more devices in accordance with the present invention.

Referring now to FIG. 6 of the drawings, there is shown a bag 41 similar to the bag 10, the bag 41 having a front panel 42, a rear panel 43 and a bottom fold 44. The rear panel 43 is of a dimension in an upward direction from the bottom fold 44 which is greater than the upward dimension of the front panel 42 to provide a portion which is folded inwardly prior to provision of the spaced side seams, one of which is shown at 45, to provide an inwardly directed flap 46 extending rearwardly of a slot 47 in the front panel 42, which slot 47 is bridged by a longitudinally extending strip of pressure sensitive contact adhesive tape 48. The adhesive tape 48 is "re-usable".

Figure 7:
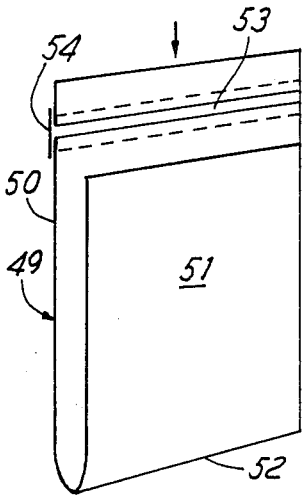

Referring now to FIG. 7 of the drawings, there is shown a bag 49 comprising front and rear panels 50, 51 and a bottom fold 52. The front panel 50 extends in an upward direction from the bottom fold 52 a distance greater than the rear panel 51 and the portion of the front panel 50 extending above and beyond the rear panel 51 is provided with a slot 53 which is bridged by adhesive tape 54. Access to the bag is from above, as indicated by the arrow in FIG. 7, and the bag is closed by folding the portion of the front panel 50 extending above and beyond the rear panel 51 rearwardly of and downwardly behind the rear panel 51 whereby the adhesive 54 exposed through the slot 53 is applied to an outer surface of the rear panel 51. The tape 54 may be provided with "permanent" or "re-usable" adhesive.

Figure 8:
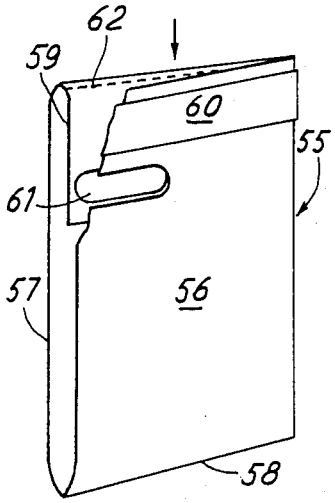

Referring now to FIG. 8 of the drawings, there is shown a carrier bag 55 which is similar in construction to the bag 41 shown in FIG. 6 in that the bag 55 is provided with a front panel 56, a rear panel 57, a bottom fold 58, an inwardly directed flap 59 and a strip of pressure sensitive contact adhesive tape 60 extending longitudinally of and bridging a slot (not shown) in the front panel 56. The adhesive of the tape 60 is a "permanent" adhesive.

Unlike the bag 41 in FIG. 6, however, the bag 55 is provided with hand slots 61 in the front and rear panels 56, 57 and in the inwardly directed flap 59 and is also provided with a line of weakening 62 in an upper portion of the flap 59 extending substantially parallel to the bottom fold 58.

The arrangement is such that, when an article is, or articles are, inserted into the bag 55, the bag is closed by means of the adhesive of the tape 60 adhering to an opposite facing surface of the flap 59 and the bag 55 subsequently can only be opened by severing the material of the flap 59 longitudinally of the line of weakening 62.

In consequence, the bag 55 provides means whereby, once articles have been purchased in a retail establishment, inserted into the bag 55 and the bag closed by means of the adhesive 60, the bag cannot subsequently be re-opened and further articles inserted therein without it being apparent that the bag previously had been closed by the adhesive tape 60 to seal therein the earlier purchased articles.

It will be appreciated that the presence of the tape 60 provides reinforcement to the bag 55 and inhibits tearing of the material of the bag which would tend to occur during transportation of a bag when loaded.

Figure 9:
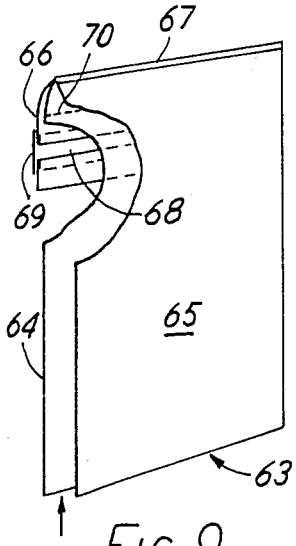

Referring now to FIG. 9 of the drawings there is shown a bag 63 comprising a front panel 64, a rear panel 65 and a flap 66 extending downwardly from an upper marginal edge of the front and rear panels 64, 65, an upper edge portion of the flap 66 being welded to corresponding upper edge portions of the front and rear panels 64, 65 to provide an upper weld 67. The flap 66 is provided with a slot 68 extending substantially parallel to the upper weld 67, the slot 68 being bridged by an adhesive tape 69 extending longitudinally of the slot 68. The adhesive of the tape 69 is a "re-usuable" adhesive. The front panel 64 is provided with a line of weakening 70 extending substantially parallel to the slot 68 and located in a direction downwardly from the weld 67 between the slot 68 and the weld 67.

The bag 63 is inverted so that contents may be inserted therein and the marginal edge portions of the front and rear panels 64, 65 remote from the upper weld 67 are welded so as to envelop the contents. The filled bag 63 subsequently is returned to the position shown in FIG. 9 for storage.

Opening of the bag 63 is effected by separating the flap 66 from the front panel 64 (united one with another by means of the adhesive tape 69) and severing the material of the front panel 64 longitudinally of the line of weakening 70.

It will be appreciated, therefore, that the bag 63, in providing the line of weakening 70, incorporates a "tamper evident" feature.

Figure 10:
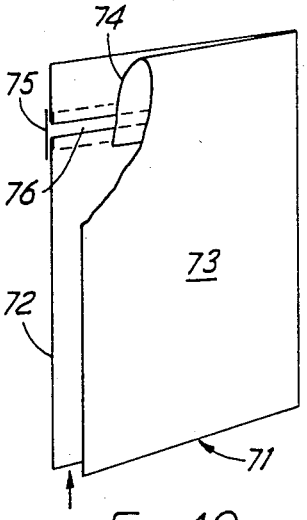

Referring now to FIG. 10 of the drawings there is shown a bag 71 which is similar to the bag shown in FIG. 6 except that the bag 71 is formed of separate front and rear panels 72, 73. The panels 72, 73 are united one with another in side welds, as with each of the embodiments shown in FIGS. 6 to 11 inclusive, and an inwardly directed flap 74 of the bag 71 is united with an inner surface of the front panel 72 by means of an adhesive tape 75 bridging and extending longitudinally of a slot 76 in the front panel 72.

The bag 71 is inverted from the position shown in FIG. 10 and contents are inserted therein in a direction of the arrow in FIG. 10. Subsequently, opposite facing marginal edges of the front and rear panels 72, 73 remote from the flap 74 are welded one to another to envelop the contents and the bag 71 then is returned to the position shown in FIG. 10 for storage. Opening and closing of the bag is effected in the same manner as described with reference to the bag 41 shown in FIG. 6.

Figure 11:
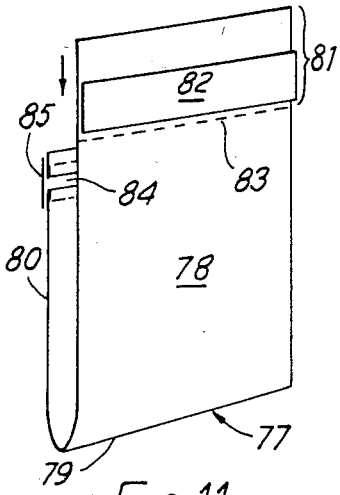

Referring now to FIG. 11 of the drawings, there is shown a bag 77 which is similar in configuration to the bag 49 shown in FIG. 7 in that the bag 77 is provided with a front panel 78 which extends upwardly from a bottom fold 79 beyond a rear panel 80 to provide a flap 81. The flap 81 is provided with a slot (not shown) extending substantially parallel to the bottom fold 79, the slot being bridged by adhesive tape 82, the adhesive of which is a "permanent" adhesive.

Unlike the bag 49 shown in FIG. 7, however, a bag 77 is provided with a line of weakening 83 extending below and substantially parallel to the tape 82 and the rear panel 80 also is provided with a slot 84 extending substantially parallel to the slot in the flap 81. The slot 84 is bridged by adhesive tape 85 extending longitudinally of the slot 84, the adhesive of the tape 85 being "re-usable".

Contents are inserted into the bag 77 in the direction of the arrow shown in FIG. 11 and, subsequently, the flap 81 is folded rearwardly behind the rear panel 80 and adheres, by means of the adhesive tape 82, to the rear surface of the rear panel. The bag can be opened only by severing the material of a bag longitudinally of the line of weakening 83. After having been thus opened, the configuration of the bag 77 is similar to the bag 10 shown in FIG. 1. The configuration of the bag 77 thus provides a "tamper evident" feature.

Figure 12:
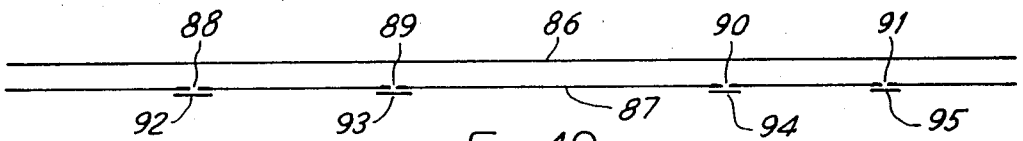
FIGS. 12 and 13 are diagrammatic representations of steps in an alternative method of manufacturing bags each provided with a device in accordance with the present invention.
Figure 13:
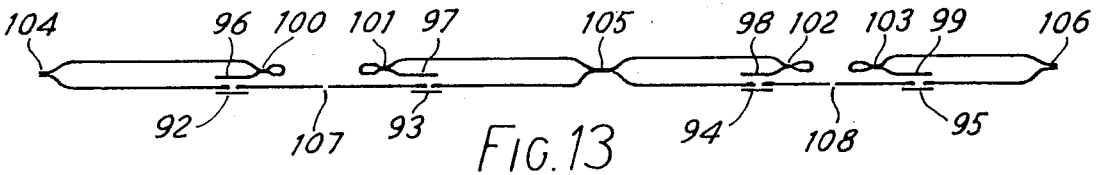
Figure 14:
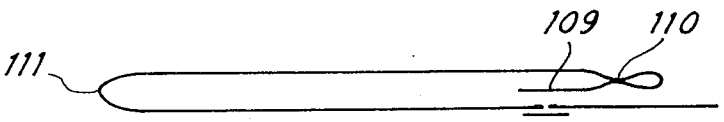
FIG. 14 is a diagrammatic representation of a bag made in accordance with the method represented diagrammatically in FIGS. 12 and 13.

Referring now to FIGS. 12 to 14 of the drawings, there is shown a further embodiment of a bag having a device in accordance with the present invention and a method of manufacturing such a bag.

Unlike the method illustrated diagrammatically in FIG. 4 of the drawings, the method of manufacturing bags shown in FIGS. 12 and 13 results in four continuous streams of bags being manufactured simultaneously. The method is achieved by providing two webs 86, 87 of synthetic plastics film material the web 86 being superimposed on the web 87. The webs 86, 87 are advanced simultaneously in a longitudinal direction, FIGS. 12 and 13 being diagrammatic cross sections of the webs in a transverse direction of movement of the webs.

Initially, the lower web 87 is slit at four locations shown at 88, 89, 90 and 91, the material of the web 87 being folded outwardly and the folds having applied thereto corresponding adhesive tapes 92, 93, 94 and 95, which tapes extend longitudinally of and bridge the corresponding slots formed by the slit and folded portions of the web 87. Simultaneously with slitting of the lower web 87, the upper web 86 also is slit at two locations extending transversely of the web 86 and the material of the web 86 is folded inwardly to form inwardly directed flaps 96, 97, 98 and 99, adjacent surfaces of the flaps 96 to 99 corresponding to the adhesive tapes 92 to 95 adhering to the respective tapes. The flaps 96 to 99 are each provided with heat seals extending longitudinally of the web 86, as shown at 100, 101, 102 and 103 respectively. The webs 86, 87 then are welded one to another in spaced longitudinally extending welds 104, 105 and 106 and the lower web 87 is severed longitudinally at two locations between opposite pairs of flaps 100, 101, 102 and 103 as shown at 107 and 108. The weld 105 also is slit longitudinally. The longitudinally slit and welded webs 86, 87 then are slit and welded one to another transversely thereof to provide a plurality of containers having spaced parallel side seams (not shown), each container having a configuration as shown in FIG. 14 which corresponds substantially to the configuration of the bag 41 shown at FIG. 6 except that the inner flap 109 is provided with a longitudinally extending weld 110 substantially parallel to a bottom fold 111.

The configuration of the bag shown in FIG. 14 is particularly adapted for containing coins whereby the portion of the bag outwardly of the weld 110 provides a finger tab which, in a filled bag, would extend radially outwardly of a bulbous configuration of a filled bag. The finger tab enables a filled bag to be grasped and easily opened.

Figure 15:
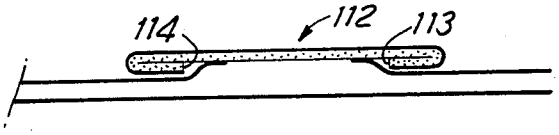
FIG. 15 is a diagrammatic cross section, similar to FIG. 2 but turned through 90°, of another embodiment of a device in accordance with the present invention.

It will be appreciated that, instead of folding the material of a bag adjacent a slot which is bridged by the adhesive tape to provide folds 15, 16; 21, 22; 31, 32 or spaced parallel filaments 39, 40 to space the adhesive surface of the tape from an opposite facing surface of the bag, the tape itself may be folded adjacent longitudinal margins thereof. In FIG. 15, for example, opposite longitudinal margins of an adhesive tape 112 are folded towards one another so that the adhesive on the margins contacts adjacent areas of adhesive between the margins to provide spaced parallel longitudinally extending marginal spacers 113 and 114.

Figure 16:
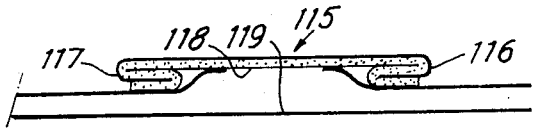
FIG. 16 is a diagrammatic cross section similar to FIG. 15 of another embodiment of a device in accordance with the present invention.

The marginal portions of the tape may each be provided with a plurality of folds, as with the tape 115 shown in FIG. 16, whereby the folded marginal portions 116 and 117 provide a resilient bias such that an adhesive surface 118 is urged in a direction away from an opposite facing surface 119 of the bag.

Figure 17:
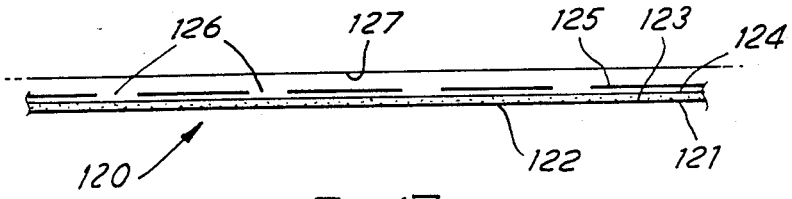
FIG. 17 is a diagrammatic cross section of a label incorporating a device in accordance with the present invention.

It will also be appreciated that a device in accordance with the present invention need not comprise a closure for a bag. In FIG. 17, for example, there is shown a label 120 comprising a sheet 121 having an outer surface 122 and an inner surface 123. The inner surface 123 has coated thereon a pressure sensitive adhesive 124. The adhesive 124 has located thereon a sheet 125 having a plurality of openings 126 such as slits, slots or rows of perforations.

In use, the label 120 is attached to a surface 127 by pressing the label 120 onto the surface 127 with the sheet 125 in contact with the surface 127. The effect is that the sheet 121 is deformed, whereby portions of the adhesive coating 124 adjacent the openings 126 are projected so as to adhere to portions of the surface 127 adjacent the openings 126. Unless a pressing force is applied to the label 120, the dimensions of the openings 126 are such that relative movement of the surface of the sheet 125 remote from the adhesive 124 and any other surface will not result in adhesive contact being effected between the surfaces.

The surface 125 of the label 120 thus may be located adjacent a support surface while the surface 122 had indicia entered thereon without the label 120 adhering to the supporting surface.

It will be appreciated, therefore, that a device in accordance with the present invention when provided in the form of a label is less expensive than a comparable label having a peelable masking sheet coated with a release substance for contacting the adhesive.

While only certain embodiments have been set forth, alternative embodiments and various modifications will be apparent from the above description to those skilled in the art. For example, the material which carries the adhesive in any of the embodiments referred to above may be such that the material is deformable repeatedly to different configurations, each configuration being maintained until the material is deformed to a different configuration. If such material is folded, the material remains in the folded condition, a so called 'dead fold', until the material is re-folded or smoothed out. On such material which possess these characteristics is metal foil. These and other alternatives are considered equivalents and within the spirit and scope of the present invention.

What is claimed is:

1. A device for uniting a first component and a second component one to another, said first component being of flexible material having a first surface and a second surface reverse to said first surface and said first component having spaced substantially parallel folds defining an elongate gap, said device comprising said folds and a membrane having pressure sensitive contact adhesive thereon, the membrane being united with said folds such that said membrane bridges said gap and said gap is of dimension transverse to a longitudinal axis of said gap such that, when said second surface of said first component is located adjacent said second component, said adhesive is spaced from contact with said second component but is contactable therewith by deforming a portion of said second component or a portion of said membrane into said gap.

2. A device as in claim 1, wherein the material of the membrane is less flexible than the material of the first and second components.

3. A device as in claim 1, wherein the material of the first and second components is less flexible than the material of the membrane.

4. A device as in claims 2 or 3, wherein the adhesive provided on the membrane is a re-usable adhesive.

5. A device as in claims 2 or 3, wherein the adhesive provided on the membrane is a permanent adhesive.

* * * * *

UNITED STATES PATENT AND TRADEMARK OFFICE

CERTIFICATE OF CORRECTION

PATENT NO. : 4,633,508

DATED : December 30, 1986

INVENTOR(S) : Bernard Sanders

It is certified that error appears in the above-identified patent and that said Letters Patent is hereby corrected as shown below:

Column 4, Line 3 "15," should be --15, 16,--.
Column 4, Line 12, "other" should be --another--.
Column 5, Line 66, "re-usuable" should be --re-usable--.

Signed and Sealed this

Twenty-fifth Day of August, 1987

*Attest:*

DONALD J. QUIGG

*Attesting Officer*

*Commissioner of Patents and Trademarks*